US006360397B1

(12) United States Patent
Babb

(10) Patent No.: US 6,360,397 B1
(45) Date of Patent: Mar. 26, 2002

(54) FEED CONTROL DEVICE FOR PLUMBING APPARATUS

(75) Inventor: Larry F. Babb, Grafton, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/572,748

(22) Filed: May 17, 2000

(51) Int. Cl.[7] ..... B08B 9/045
(52) U.S. Cl. ..... 15/104.33
(58) Field of Search ..... 15/104.31, 104.32, 15/104.33

(56) References Cited

U.S. PATENT DOCUMENTS 2,266,659 A * 12/1941 Robinson et al.
3,882,565 A 5/1975 Irvin
4,153,966 A * 5/1979 Irwin
4,395,791 A * 8/1983 Irwin
5,031,263 A 7/1991 Babb
5,640,736 A * 6/1997 Salecker

* cited by examiner

*Primary Examiner*—Terrence R. Till
(74) *Attorney, Agent, or Firm*—Vickers, Daniels & Young

(57) ABSTRACT

A device for axially feeding a drain cleaning snake relative to a storage drum therefor comprises axially spaced apart support members having openings therethrough for receiving the snake and a plurality of snake driving rolls spaced apart about the axis of the openings and having opposite ends interconnected with the support members for the support members to be pivotal relative to one another about the axis of the openings so as to displace the driving rolls between neutral and activating positions in which the roll axes are respectively parallel to and skewed relative to the openings and in which the driving rolls respectively disengage and drivingly engage the snake. The support members are spring biased to the neutral position of the driving rolls.

45 Claims, 12 Drawing Sheets

FEED CONTROL DEVICE FOR PLUMBING APPARATUS

BACKGROUND OF THE INVENTION

This invention relates to the art of drain cleaning apparatus and, more particularly, to an improved feed control arrangement by which a flexible snake of such apparatus can be axially advanced and retracted relative thereto during a drain cleaning operation.

Drain cleaning apparatus of the character to which the present invention is directed is generally comprised of a motor driven snake or drain cleaning drum in which the snake or drain cleaning cable is wound about the axis of the drum and is rotatable therewith. The drum has an open front end through which a free or outer end of the snake extends for entrance into a drain to be cleaned, and a feed control device for the snake is generally supported on the frame of the apparatus forwardly of the open front end of the drum for receiving the snake. The snake, as is conventional, is an elongate flexible member made of tightly wound spring wire, and the free or outer end thereof is adapted to be displaced outwardly and inwardly relative to the drum through operation of the feed mechanism.

Often, as shown for example in U.S. Pat. Nos. 3,882,565 to Irwin, et al. and 5,031,263 to Babb, et al., the snake feeding mechanism is comprised of three drive rolls circumferentially spaced apart to provide an opening through which the snake extends and which rolls are adapted to engage the snake so as to cause the latter to move inwardly or outwardly of the snake drum in response to rotation of the drum and thus the snake. Generally, two of the rollers are radially adjustable relative to the snake axis so as to enable the feed mechanism to accommodate snakes having different diameters, and the third roller is generally spring biased so that the snake is firmly captured between the three rollers. The rollers are either skewed relative to the snake axis to achieve driving of the snake, as shown in the patent to Babb, et al., or are externally grooved to have a contour corresponding to that of the outer surface of the snake.

In the feed control arrangements heretofore available for use in connection with power driven drain cleaning apparatus, including those specifically referenced above, the snake feed control arrangements are structurally complex, difficult to access with respect to cleaning and/or performing maintenance and replacement operations with respect to parts thereof, and require time-consuming adjustments or disassembly operations in connection with the initial feeding of the enlarged auger contoured end of the snake or an auger or blade attachment thereon through the feed device. In this respect, for example, the feed rolls are enclosed in a housing and cannot be easily accessed for cleaning, maintenance or replacement without at least partial disassembly of the housing, or removal of the rolls, whereby access in any event requires considerable time and effort. In the arrangements in which the feed rolls are mounted in a housing for radial adjustment relative to an opening through the housing for the snake, the supporting structures are complex, adjustment is time consuming and displacement of the rolls radially outwardly of the opening to accommodate withdrawal or insertion of the tip end of a snake is also time consuming, especially if it is necessary to remove one of the feed rolls. Structural complexity not only adds to the manufacturing costs but also often makes the operation of the mechanism cumbersome. Further, the inability to obtain accurate adjustment of the rollers relative to the axis of the feed mechanism can result in an erratic action during use of the apparatus, and such action poses undesirable wear on the component parts of the snake feeding mechanism and causes instability with respect to the support of the apparatus during operation thereof. Still further, some of the previous feed arrangements, such as that shown in the patent to Irwin, et al., require the use of a reversible motor in order to achieve feed of the snake in opposite directions relative to the drum. While others of the previous feed mechanisms, such as that shown in U.S. Pat. No. 4,580,306 to Irwin, provide for reversing the skew of the drive rolls so as to enable both extension and retraction of the snake in response to rotation of the drum in the same direction, the arrangements for adjusting the skew of the drive rolls is structurally complex and, most often, requires manual displacement of the adjusting mechanism to release driving engagement of the rolls with the snake.

SUMMARY OF THE INVENTION

A snake feed control device in accordance with the present invention is of simple structure and comprised of a mini-mum number of parts which are structurally interrelated so as to provide a feeding device in which the foregoing and other problems and disadvantages encountered in connection with such devices heretofore available are minimized or overcome. More particularly in this respect, a snake feeding device in accordance with the present invention is comprised of a pair of support members having aligned openings therethrough for receiving a snake and which are axially spaced apart and interconnected with one another by a plurality of snake driving roll units circumferentially spaced apart about the axis of the openings. The snake driving roll units include roll members mounted on shafts having axially opposite ends which are pivotally interconnected with the support members such that the latter can be rotated in opposite directions relative to one another so as to displace the snake driving rolls between a neutral position in which the rolls do not drivingly engage the snake and an actuating position in which the rolls drivingly engage the snake for displacing the snake axially relative to the feeding device. In the neutral position, the roller shafts are parallel to the axis of the openings through the support members and the driving rolls are radially spaced from the axis of the openings through the support members so as to enable the enlarged auger contour or attachment on the free end of a snake to be readily movable through the device. In the actuating position the roller shafts and thus the rollers are skewed relative to the axis and the rollers are in inner positions to engage a snake therebetween, whereby rotation of the snake and engagement of the rolls therewith displaces the snake axially relative to the support members.

Preferably, the support members are rotatably displaceable in opposite directions from the neutral position, whereby the drive rolls can be skewed in opposite directions relative to the openings through the support members so as to enable displacement of the snake in axially opposite directions relative to the feeding device without reversing the direction of rotation of the snake. This advantageously enables both extending and retracting the snake relative to a storage drum without having to reverse the rotation of the latter to achieve retraction of the snake thereinto. It is also preferred to provide for the axially opposite ends of the driving roll shafts to be pivotally interconnected with the support members by ball and socket type joints therebetween, and to provide a biasing spring arrangement by which the support members and driving rolls are biased to the neutral position and returned thereto when released from an actuating position. These features advantageously enable minimzing the number of component parts and simplifying the structure of the feeding device while improving the ease and reliability of operation thereof and minimizing the time and effort required to perform maintenance on and/or replace parts of a device.

It is accordingly an outstanding object of the present invention to provide an improved feed control device for axially feeding a snake in power driven drain cleaning apparatus.

Another object is the provision of a snake feed control device of the foregoing character which comprises snake driving rolls mounted between axially spaced apart, relatively rotatable support components for displacement between neutral and actuating positions relative to a snake extending through the device in response to relative rotational displacement of the support components.

A further object is the provision of a feed control device of the foregoing character wherein an enlarged auger shaped or other tip end of a snake can be moved through the device with the driving rolls in the neutral positions thereof without disassembly of any part of the device.

Yet a further object is the provision of a feed control device of the foregoing character in which the component parts can be readily disassembled to facilitate maintenance and/or replacement of parts.

Another object is the provision of a feed control device of the foregoing character which is easy to operate and reliable in operation and which is comprised of a minimum number of parts structured and structurally interrelated to provide a compact feed control device which can accommodate different sized snakes without structural modification or adjustment, which minimizes the time required to feed or retract a snake therethrough and which is more economical to produce and maintain than such devices heretofore available.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
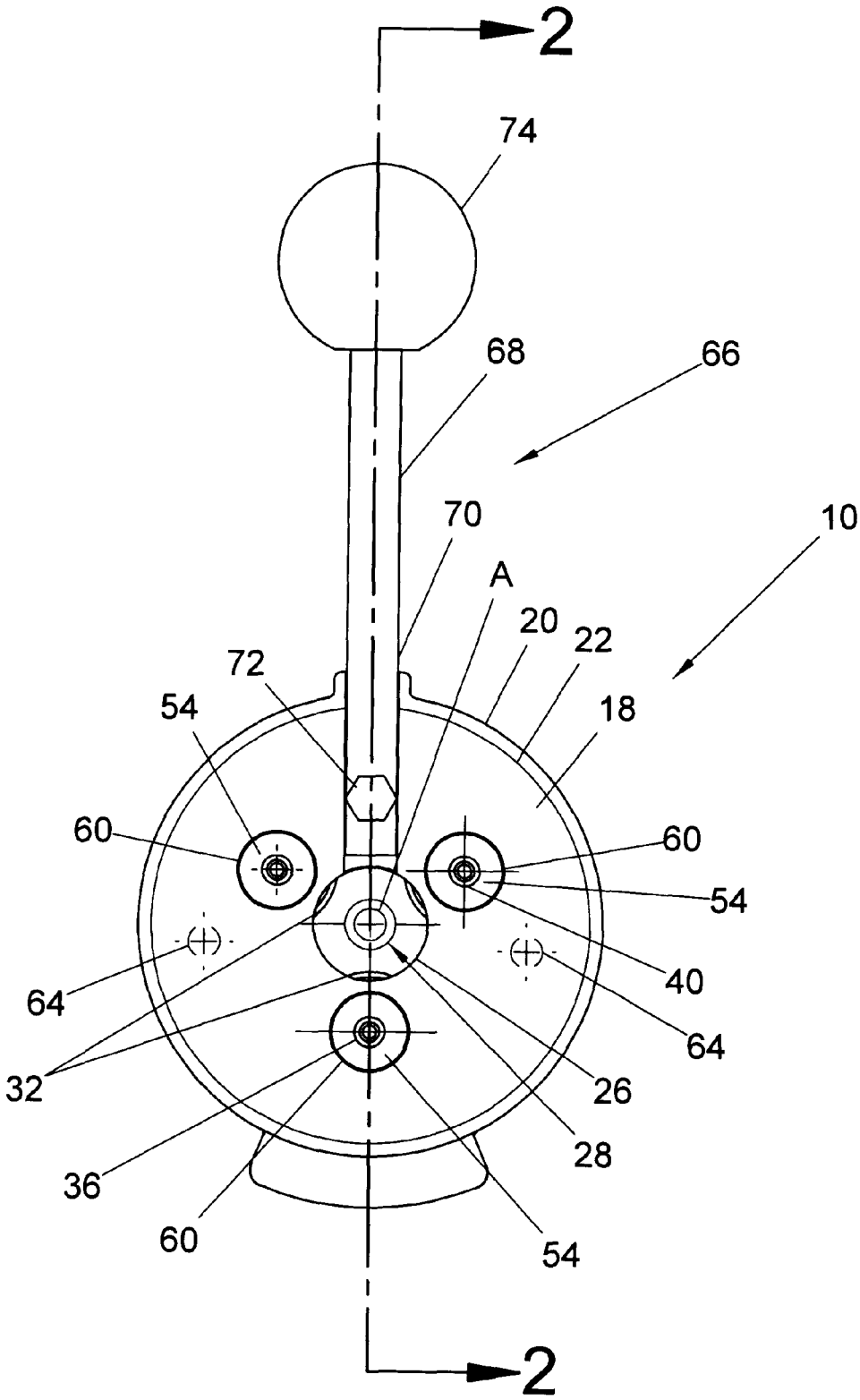
FIG. 1 is a front elevation view of one embodiment of a feed control device in accordance with the present invention.
Figure 2:
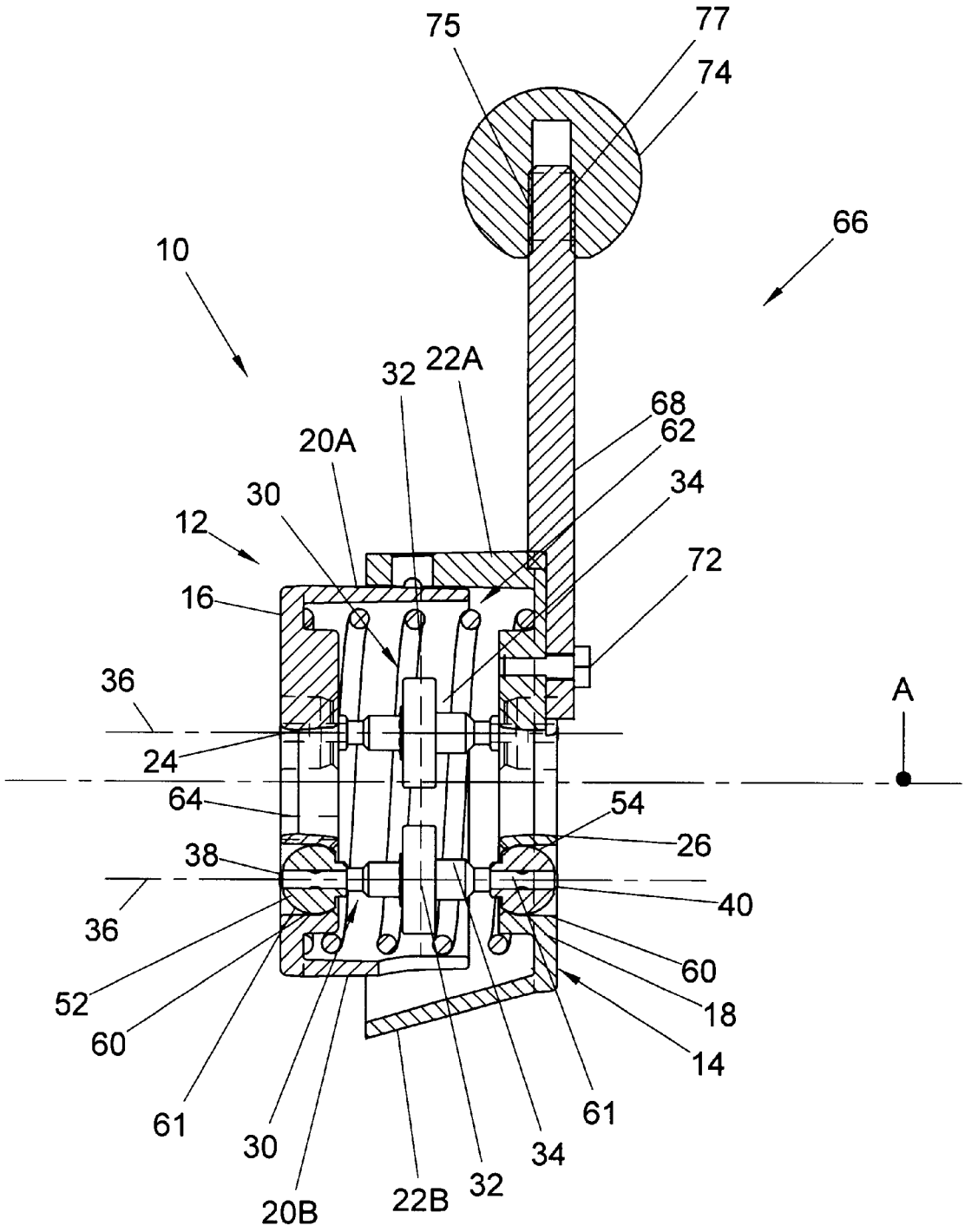
FIG. 2 is a sectional elevation view of the device as seen along line 2—2 in FIG. 1.

Referring now in greater detail to the drawings, wherein the showings are for the purpose of illustrating preferred embodiments of the invention only and not for the purpose of limiting the invention, FIGS. 1 and 2 illustrate a feed control device 10 having an axis A and axially opposed support members 12 and 14 having axially spaced apart end walls 16 and 18, respectively, and circular outer side walls 20 and 22 extending axially inwardly from end walls 16 and 18, respectively. Walls 20 and 22 are designed to substantially telescopically interengaged, and support members 12 and 14 are relatively displaceable both axially and rotatably relative to axis A in the manner and for the purpose which will become apparent hereinafter. As shown in FIG. 2, walls 20A and 22A lie in a plane substantially parallel to axis A. A portion of the top surface of wall 20A is positioned under a portion of the lower surface of wall 22A. Wall 20B is also shown to lie in a plane substantially parallel to axis A. Wall 22B is shown to slope downwardly from axis A, thereby form a space between wall 20B and 22B to allow dirt and/or fluids to exit the interior of the feed control device. End walls 16 and 18 are provided with openings 24 and 26, respectively, which are coaxial with axis A for receiving a drain cleaning snake which is displaced axially, forwardly and rearwardly of the feed device as set forth more fully hereinafter.

Figure 6:
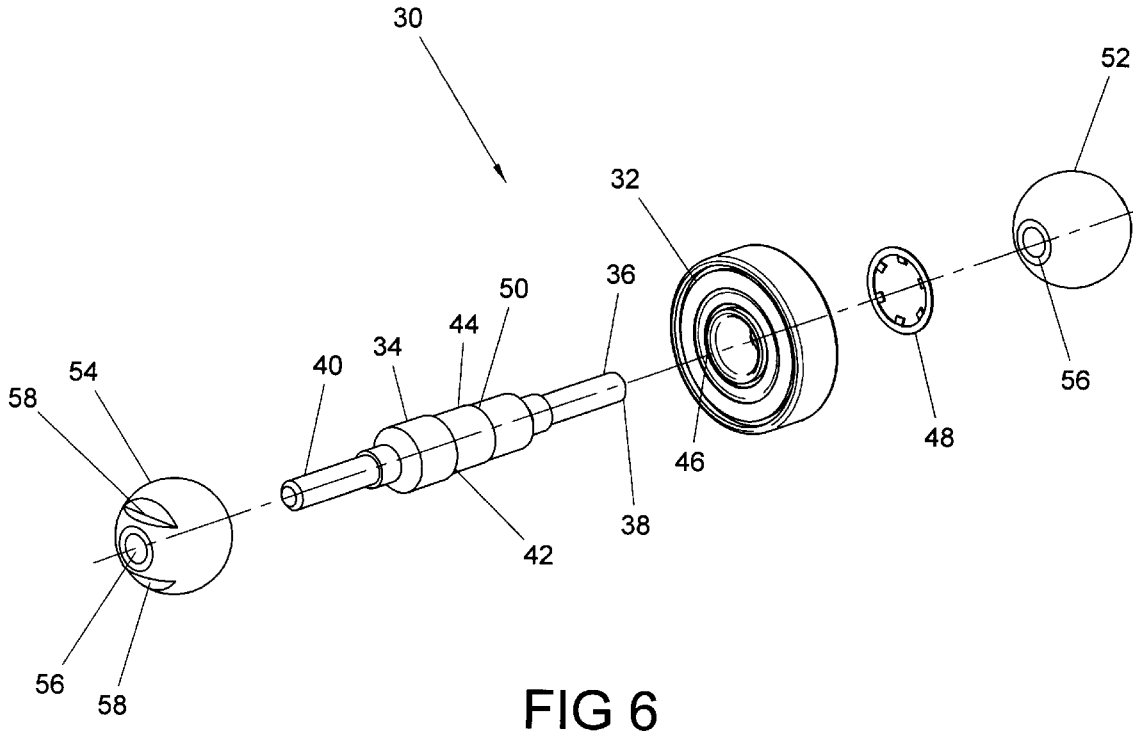
FIG. 6 is an exploded perspective view of a driving roll unit for a feed control device in accordance with the invention.

Feed device 10 further includes three snake driving roll units 30 which are axially between and interconnect end walls 16 and 18 of the support members and which are equally spaced apart circumferentially about axis A of the device. As best seen in FIGS. 2 and 6 of the drawing, each of the driving roll units 30 comprises a driving roll member 32 rotatably mounted on a driving roll shaft 34 having an axis 36 and axially opposite ends 38 and 40 which are threaded for the purpose set forth hereinafter. Shaft 34 has a radially outwardly extending circumferential shoulder 42 intermediate the opposite ends thereof and a roller supporting portion 44 axially adjacent the shoulder, and driving roll member 32 has an opening 46 axially therethrough which receives supporting portion 44 of the shaft for roll member 32 to be rotatable about axis 36. Roll member 32 is axially positioned on shaft 34 by shoulder 42 and a spring retaining clip 48 which is releasably interengaged in a spring clip groove 50 in the shaft. Each of the driving roll units further includes spherical balls 52 and 54 respectively mounted on ends 40 and 38 of shaft 34 by corresponding internally threaded bores 56 therethrough which are threadedly interengaged with the externally threaded shaft ends. For the purpose set forth hereinafter, each of the balls 52 and 54 is provided with a pair of diametrically opposed notches 58 each of which is defined by intersecting planar walls, not designated numerically, which extend axially and radially with respect to axis 36.

Figure 3:
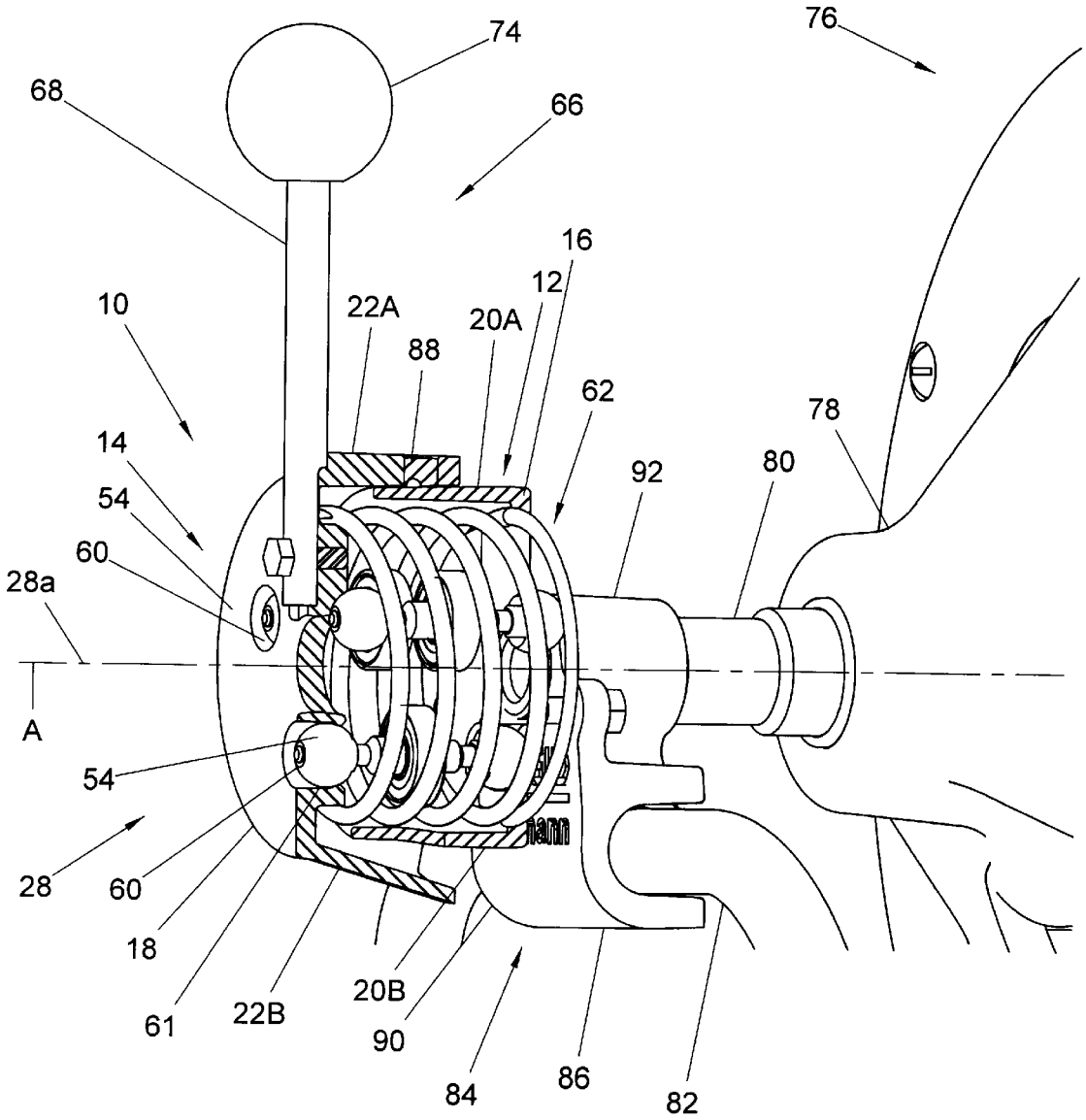
FIG. 3 is a perspective view of the device, partially in section, mounted on the frame of drain cleaning apparatus and showing the driving rolls in a neutral or outer position relative to a drain cleaning snake extending forwardly of the apparatus.

As will be appreciated from FIGS. 1, 2 and 3 of the drawings, the axially outer side of each of the walls 16 and 18 of support members 12 and 14 is provided with three ball sockets 60 equally spaced apart about axis A and having a constricted opening 61 inwardly through the corresponding wall from the bottom of the socket. The threaded ends 38 and 40 of the roll shafts extend axially outwardly through openings 61 and receive the corresponding one of the spherical balls 52 and 54, whereby it will be appreciated that each of the opposite ends of each driving roll unit 30 is pivotally interconnected with the corresponding one of the walls 16 and 18 of the support members. When the feeding device is in a neutral position with respect to feeding snake, as shown in FIGS. 1–3, the ball sockets in walls 16 and 18 are axially aligned, whereby the axes 36 of the driving roll members 32 and shafts 34 are parallel to one another and to axis A of the feeding device. A coiled compression spring 62 extends about driving roll units 30 and engages against the inner sides of walls 16 and 18 of the housing members to bias the latter axially away from one another and, as will be appreciated from FIG. 2, balls 52 and 54 interengage with sockets 60 to limit axial displacement between the housing members in the direction of separation thereof. In the embodiment disclosed, wall 16 of housing member 12 is provided with a pair of openings 64 therethrough for mounting the feed device on a plumbing tool as described hereinafter, and housing member 14 is provided with an operating handle 66 for actuating the feeding device in the manner and for the purpose set forth hereinafter. Operating handle 66 includes a stem 68 having a radially inner end received in a recess 70 therefor in wall 18 of housing member 14 and secured thereto such as by a hex head screw 72. The operating handle further includes an operating knob 74 mounted on stem 66 by way of an internally threaded bore 75 in the knob receiving externally threaded outer end 77 of stem 68. It will be appreciated from the foregoing description that assembly and/or disassembly of the snake feeding device is readily achieved as a result of the removable mounting of balls 52 and 54 on opposite ends of shafts 34 together with the removable mounting of driving rolls 32 on the shafts. In this respect, for example, removal of balls from the opposite ends of shafts 34 releases housing members 12 and 14 for axial separation without removing driving roll members 32 from the shafts. Alternatively, the balls at the ends of the shafts adjacent snap ring groove 50 can be removed and then driving roll members 32 can be removed by removal of the snap rings, after which the shaft and the balls on the opposite ends thereof can be withdrawn through the corresponding socket opening.

As mentioned hereinabove, feeding device 10 is adapted to be mounted on drain cleaning apparatus which may, for example, be a motor driven drain cleaner sold by the Ridge Tool Company of Elyria, Ohio under the latter's product designation K-40. The latter, as shown in part in FIG. 3 of the drawing, comprises a frame which supports a cable drum assembly 76 for rotation about a cable drum axis which coincides with axis A of feed device 10. The drum assembly is adapted to be driven by an electric motor, not shown, and the drain cleaning snake or cable is coiled in the drum housing about the drum axis and extends forwardly through forwardly extending hub 78 and exit collar 80 of the drum assembly. The frame of the drain cleaning apparatus includes a portion 82 extending horizontally across the front end of drum assembly 76 below exit collar 80, and feed device 10 is mounted on frame portion 82 by means of a mounting bracket 84 having a lower U-shaped mounting portion 86 suitably secured to frame portion 82 by connection arrangement 88. Mounting bracket 84 further includes an upwardly extending mounting plate portion 90 and a sleeve portion 92 extending rearwardly therefrom and rotatably receiving exit collar 80, and feed device 10 is mounted on plate portion 90 by a pair of screws extending through openings 64 therefor and outer wall 16 of housing member 12. As will be appreciated from FIG. 3, drain cleaning snake extends through hub 78 and exit collar 80 and through feed device 10 for entry of the free or outer end of the snake into a drain or waste line to be cleaned. In the embodiment illustrated, free end of the snake is formed to provide an auger tip which is radially enlarged relative to the remainder of the snake. As is well known, other auger or cutter components can be provided on the free end of the snake.

Referring now to FIGS. 1–5, FIGS. 1–3 illustrate the snake feed device in a neutral position in which the axes 36 of driving roll units 30 are parallel to one another and to axis A and in which the driving roll members 32 are transverse to axis A and spaced radially outwardly a maximum distance therefrom. As will be appreciated from FIG. 1, driving roll members 32 of driving roll units 30 disengage snake in the neutral position of feed device 10, whereby rotation of drum assembly 76 rotates snake relative to the feed device but without any axial displacement of the snake relative thereto. Furthermore, the spacing of roller members 32 from axis A in the neutral position provides clearance for introducing or removing enlarged end of the snake from the device without interference thereof with the roller members.

Figure 4:
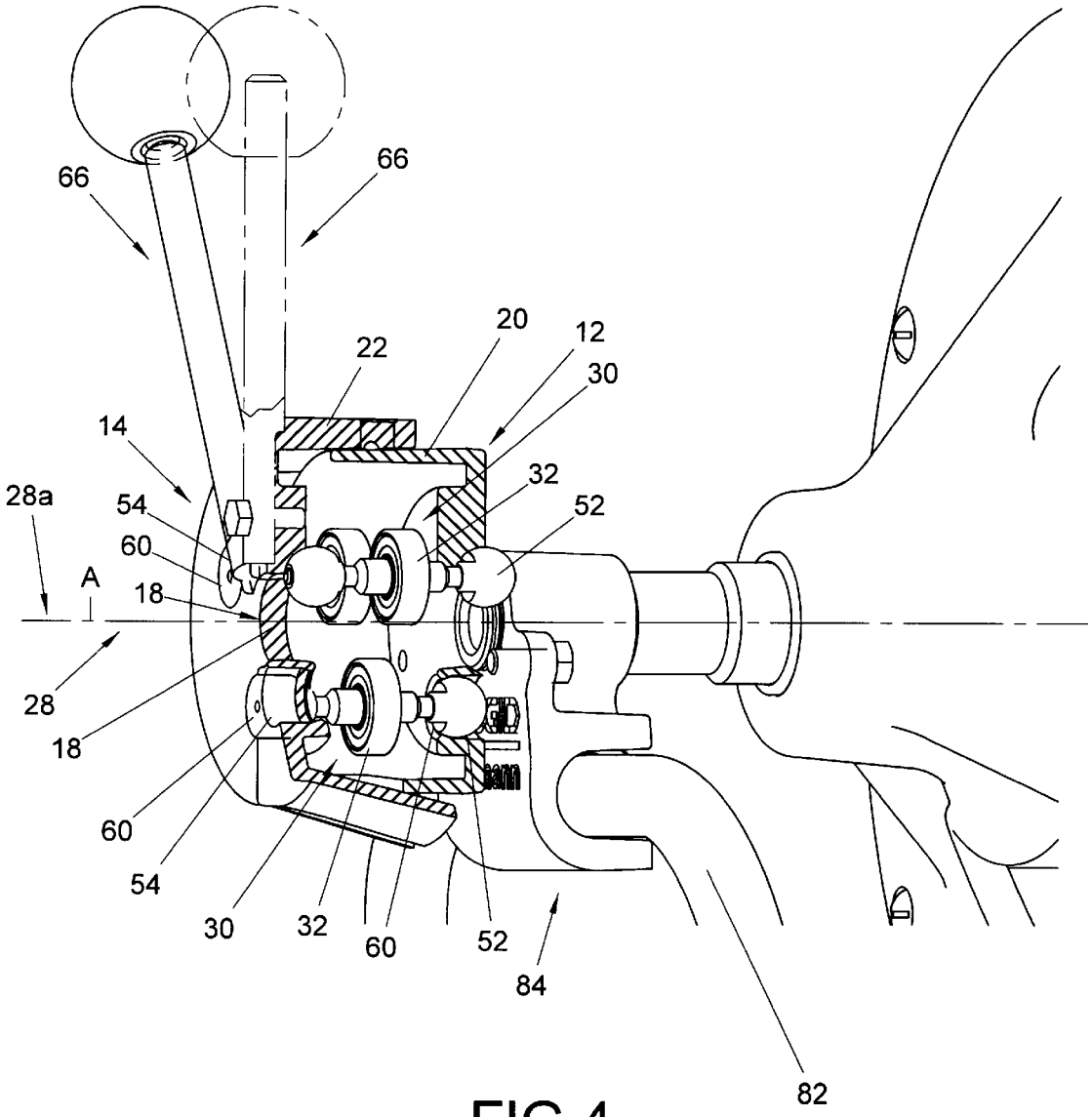
FIG. 4 is a perspective view similar to FIG. 3 with the spring removed for clarity and showing the driving rolls in a first actuated position relative to the snake.

FIG. 4 illustrates displacement of housing member 14 counterclockwise about axis A from the neutral position represented by the broken line position of operating handle 66 to an actuating position shown by the solid line positions of the component parts. In response to displacement of operating handle 66 from the broken line to the solid line position thereof shown in FIG. 4, the fixed position of housing member 12 relative to axis A provided by the attachment of housing 12 to mounting bracket 84 results in the displacement of the axes 36 and driving roll members 32 of driving roll units 30 to positions in which the axes and driving roll members are skewed relative to axis A. Moreover, such relative rotational displacement between housing members 12 and 14 results in the housing members being axially displaced toward one another against the bias of spring 62 in that balls 52 interengaged with wall 18 of housing member 14 remain axially fixed while the axial positions of balls 52 interengaged with wall 16 of housing member 12 is shortened in the direction toward wall 18 as a result of the skewing of axes 36 relative to axis A. The displacement of driving roll members 32 from the neutral to the activating positions thereof shown in FIG. 4 moves the driving roll members radially inwardly of axis A into the skewed positions which, in response to engagement thereof with the rotating snake, cause the latter to be axially displaced relative to feed device 10 in the direction of extension or retraction relative to drum assembly 76 which depends on the direction of rotation thereof about axis A. Accordingly, it will be appreciated that the driving roll members in the activating positions thereof are positioned closer to axis A then when the driving roll units are in the neutral position. As long as the operating handle is held in the solid line position shown in FIG. 4, the rotating snake will continue to be axially fed relative to feed device 10 in accordance with the direction of rotation of the snake drum. When handle 66 is released from the solid line position shown in FIG. 4, the force of compression spring 62 biases housing member 12 axially outwardly away from housing member 14, thus returning the component parts to the neutral position shown in FIG. 3.

Figure 5:
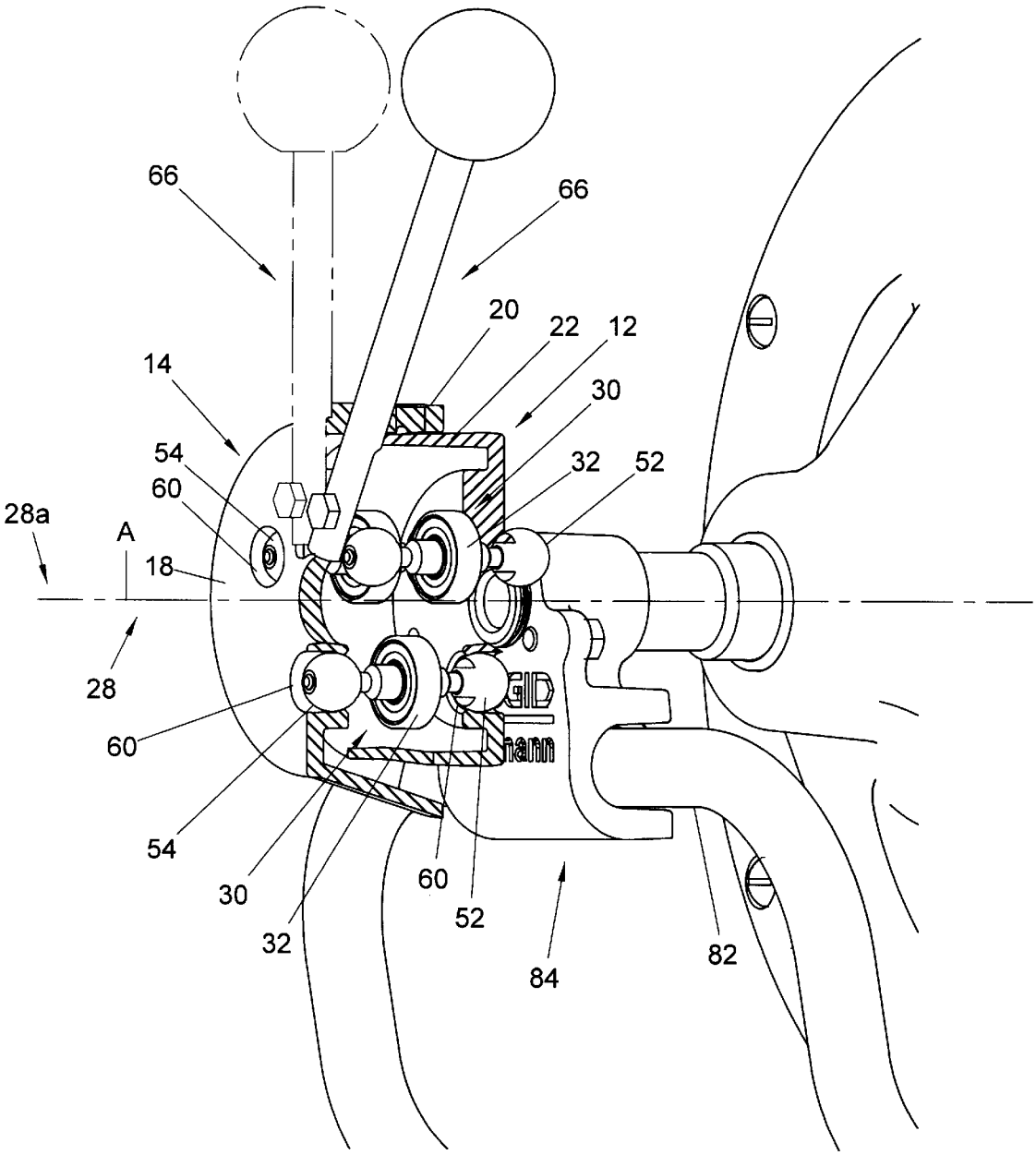
FIG. 5 is a perspective view similar to FIG. 4 and showing the driving rolls in a second actuated position relative to the snake.

As will be appreciated from the foregoing descriptions of FIGS. 3 and 4, and as shown in FIG. 5, operating handle 66 is adapted to be displaced clockwise from the neutral position shown by broken lines in FIG. 5 to another activating position shown by the solid line positions of the component parts of the feed mechanism in FIG. 5 and in which the driving roll axes and driving roll members 32 of the driving roll units 30 are skewed relative to axis A in the direction opposite the skew of the parts in FIG. 4. Displacement of operating handle 66 to the solid line position shown in FIG. 5 results in similar displacement of the component parts relative to one another as described in connection with FIG. 4 and, in part in this respect, results in the displacement of housing member 14 toward housing member 12 against the bias of compression spring 62. Accordingly, the driving roll members are displaced radially inwardly to engage the rotating snake whereby, without changing the direction of rotation of the snake drum assembly 76 the snake is axially driven relative to the latter in the direction opposite that when the component parts are in the positions thereof shown in FIG. 4. Again, release of the operating handle from the solid line position shown in FIG. 5 results in displacement of the component parts back to the neutral position by the bias of spring 62 and in which the driving roll members disengage the snake whereby the latter rotates but is not axially displaced relative to the drum assembly. The diametrically opposed recesses 58 in ball members 52 and 54 of the driving roll units 30 provide for skewing displacement of the drive roll units without interference between the balls and the restricted inner ends of the ball sockets 60. Further, while it will be appreciated that biasing spring 62 is not necessary for operation of the feed device, the biasing effect thereof is preferred in that it stabilizes the component parts against unintentional displacement from the neutral to one or the other of the activating positions as well as promoting the return movement of the component parts from an activating to the neutral positions thereof.

Figure 7:
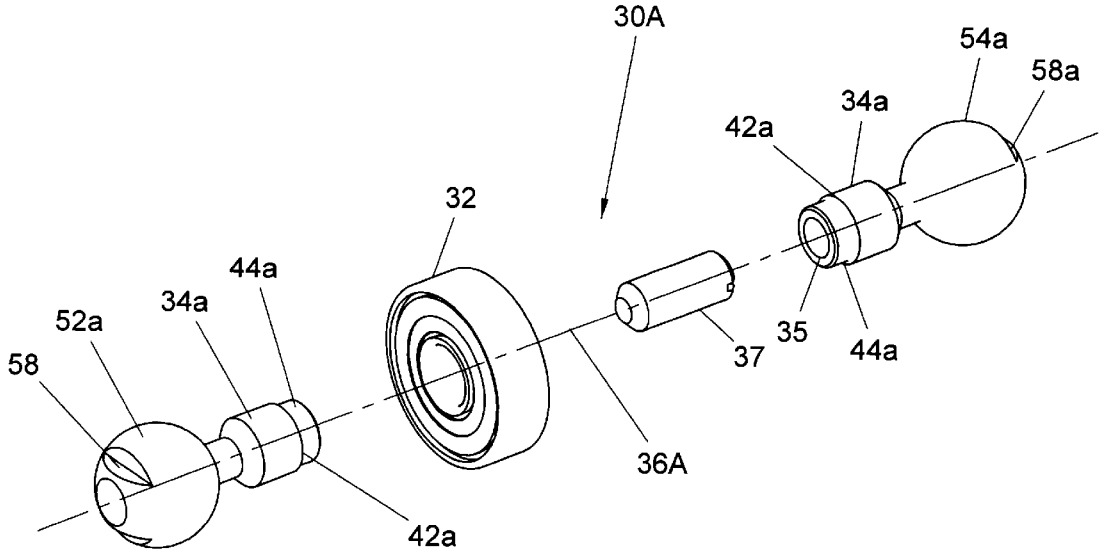
FIG. 7 is an exploded perspective view of another driving roll unit for a feed control device in accordance with the invention.

FIG. 7 illustrates a modification of the driving roll units 30, designated 30A, and which comprises a driving roll member 32*a* rotatably mounted on a driving roll shaft which is defined by shaft portions 34*a* integral with the spherical balls 52*a* and 54*a*. Each shaft portion 34*a* has a radially outwardly extending circumferential shoulder 42*a* intermediate the opposite ends thereof and a roller supporting portion 44*a* axially adjacent the shoulder. Driving roll member 32*a* has an opening 46*a* axially therethrough which receives supporting portions 44*a* of the shaft for roll member 32*a* to be rotatable about shaft axis 36A, and the roll member is axially positioned on the shaft by shoulders 42*a*. Each of the shaft portions 34*a* has an internally threaded bore 35, and the shaft portions are interconnected by a set screw 37 such that the innermost ends of supporting portions 44*a* about to axially capture roll member 32*a* between shoulders 42*a*. As described hereinabove with regard to driving roll units 30, each of the balls 52*a* and 54*a* is provided with a pair of diametrically opposed notches 58*a* each of which is defined by intersecting planar walls, not designated numerically, which extend axially and radially with respect to axis 36A.

Figure 8:
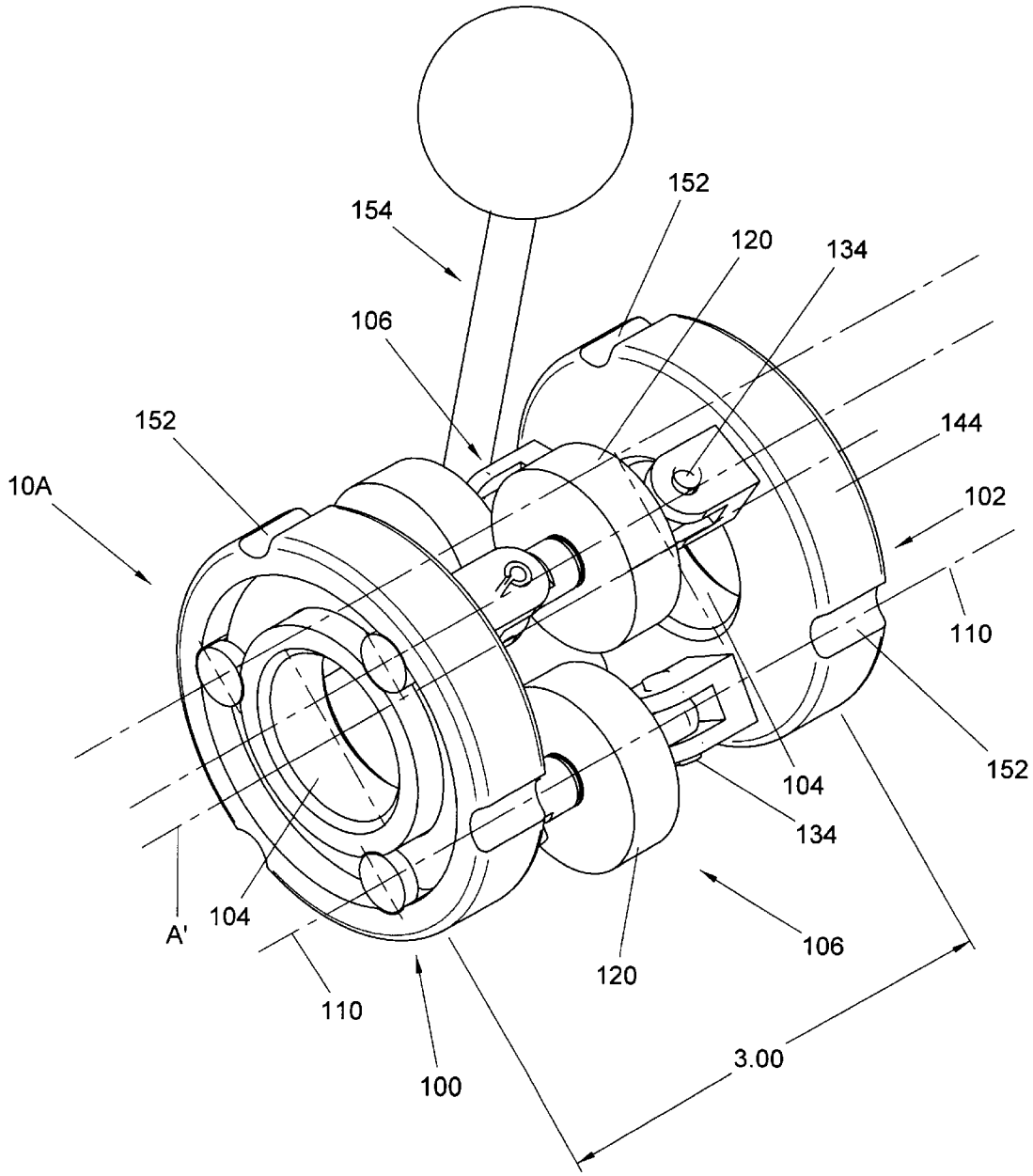
FIG. 8 is a perspective view of another embodiment of a feed control device in accordance with the invention showing the driving rolls in the neutral position.
Figure 9:
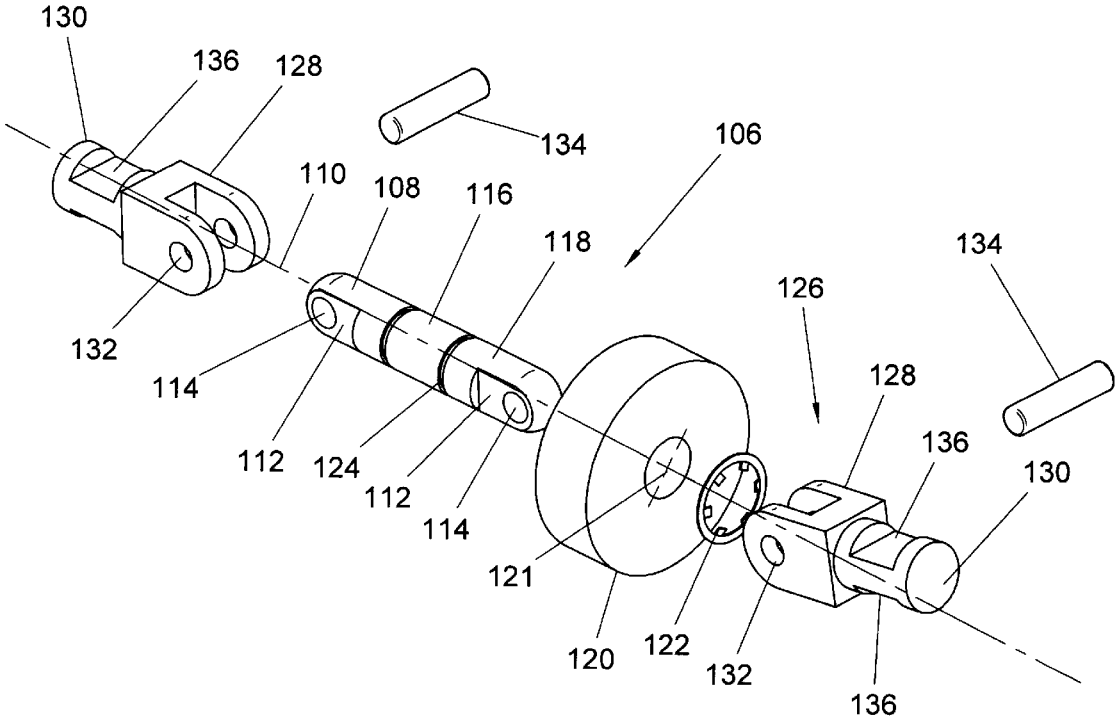
FIG. 9 is an exploded perspective view of a driving roll unit for the device shown in FIG. 8.

FIGS. 8–12 of the drawing illustrate another embodiment of a feed control device in accordance with the present invention. In this embodiment, the feed device 10A has an axis A' and comprises axially spaced apart support members 100 and 102 having openings 104 therethrough for receiving a snake and having a plurality of snake driving roll units 106 equally spaced apart about axis A' and having axially opposite ends pivotally interconnected with support members 100 and 102 as set forth more fully hereinafter. As best seen in FIG. 9, each of the driving roll units 106 includes a shaft 108 having an axis 110 and axially opposite ends defined by flat mounting tabs 112 having openings 114 extending therethrough transverse to axis 110. Shaft 108 includes a radially outwardly extending circumferential shoulder 116 intermediate the opposite ends thereof and a circular roll support portion 118 adjacent shoulder 116, and a driving roll member 120 has an opening 121 therethrough receiving roll support portion 118 by which the roll member is rotatably supported on the shaft. The roll is axially retained on the shaft by a spring clip component 122 removably received in a peripheral groove 124 provided therefor adjacent roll support portion 118. Each of the driving roll units 106 includes mounting forks 126 at the axially opposite ends of shaft 108, and each of the mounting forks includes an axially inwardly open U-shaped mounting bracket 128 and a circular mounting pin 130 extending axially outwardly from the bite portion of mounting bracket 128. The legs of mounting bracket 128 are provided with aligned openings 132 therethrough, and the legs are adapted to receive mounting tab 112 on the corresponding end of shaft 108 with opening 114 therethrough aligned with openings 132 to receive a roll pin 134 by which the mounting bracket and shaft are interconnected for pivotal displacement about a pin axis transverse to axis 110 of the shaft. For the purpose set forth more fully hereinafter, each of the mounting pins 130 is provided with a pair of diametrically opposed recessed flats 136 intermediate the opposite ends thereof.

Figure 10:
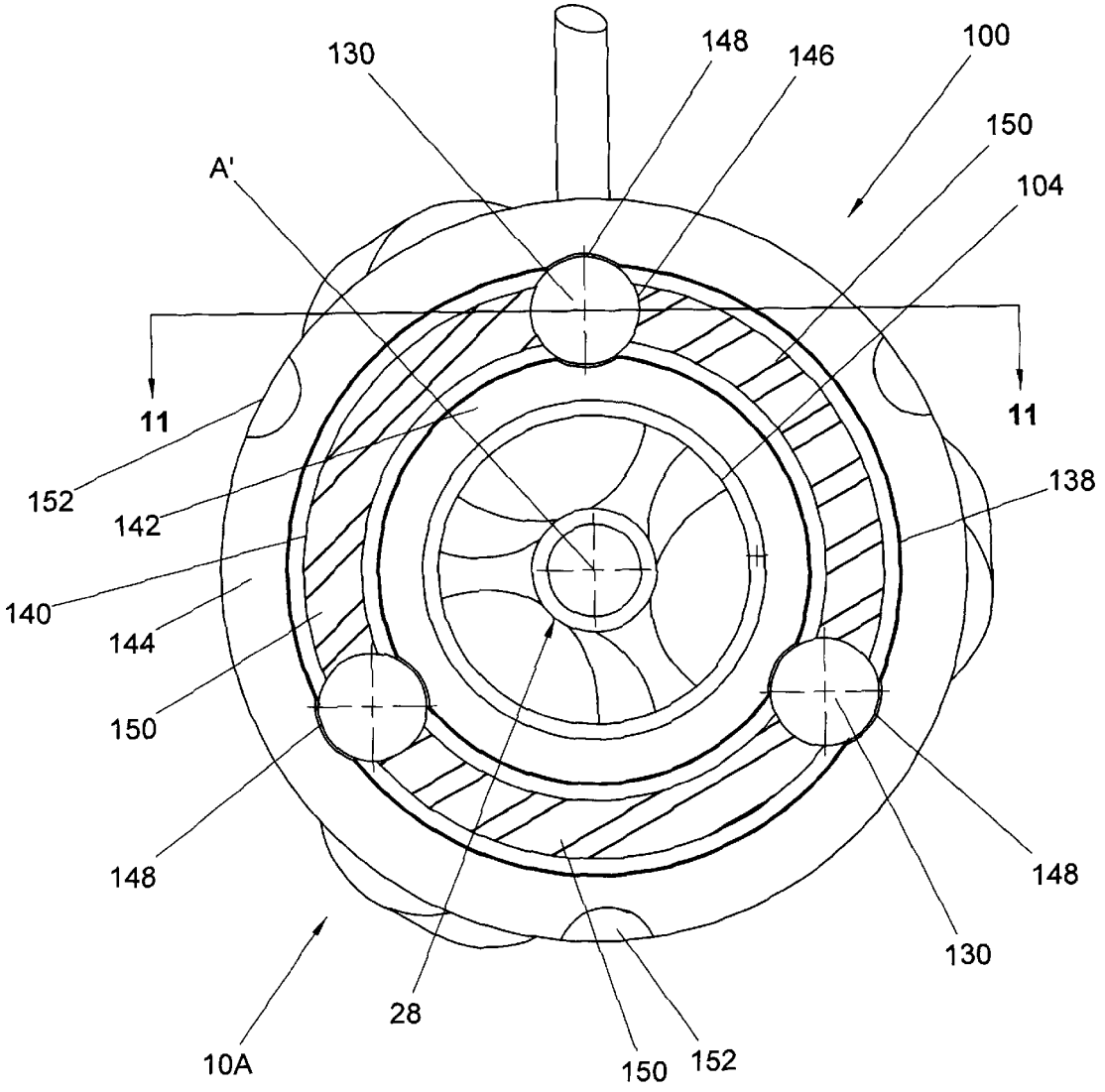
FIG. 10 is a front elevation view of the device shown in FIG. 8.
Figure 11:
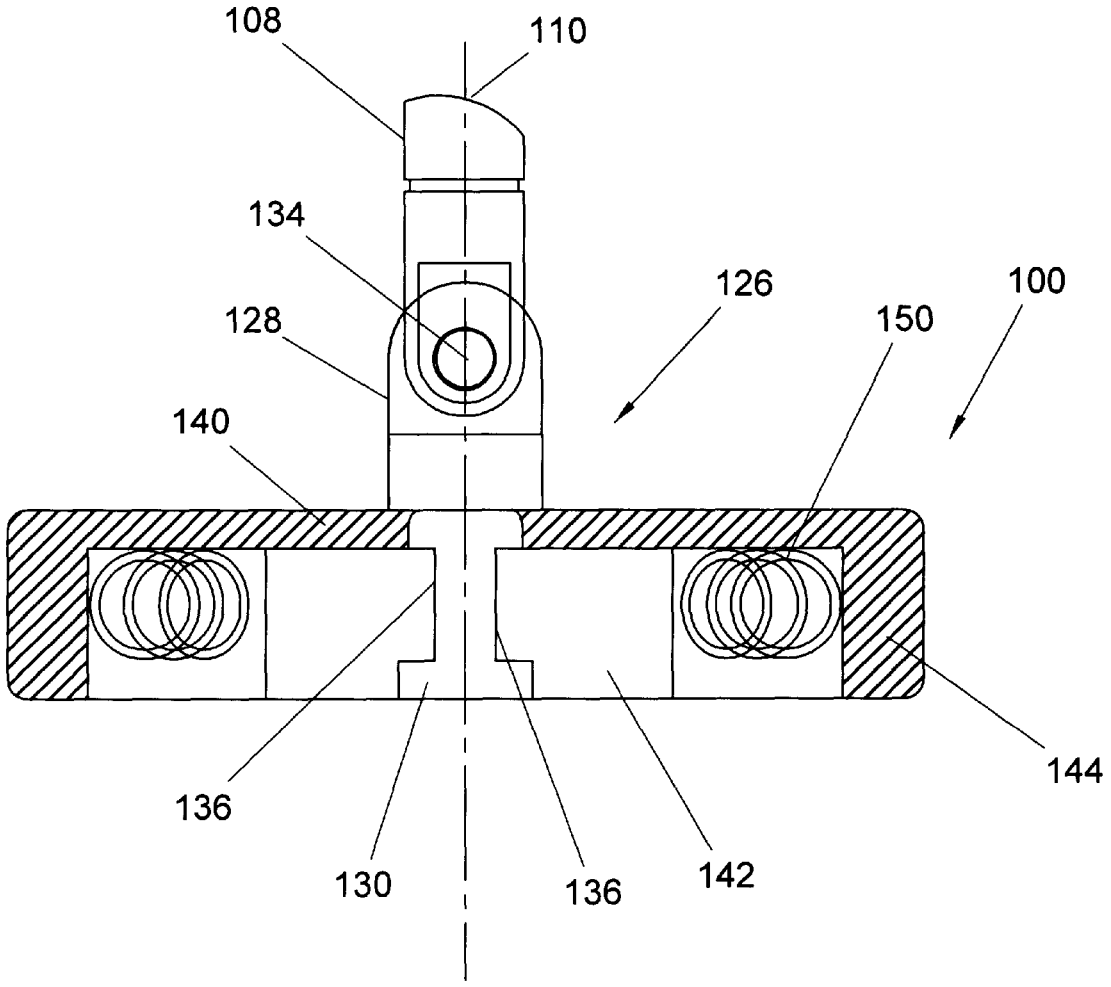
FIG. 11 is a plan view in section taken along line 11—11 in FIG. 10; and, FIG. 12 is a perspective view of the feed device showing the driving rolls in an actuated position thereof.

Support members 100 and 102 are structurally identical insofar as the mounting of driving roll units 106 therebetween is concerned, whereby it will be appreciated that the following description with regard to support member 100 is also applicable to support member 102. As best seen in FIGS. 10 and 11, each of the support members 100 and 102 includes an axially outwardly open circumferentially continuous annular recess 138 radially outwardly of opening 104 through the support member and which provides for the support member to have a U-shaped contour in cross-section which includes an inner wall 140 transverse to axis 110 and axially outwardly extending radially inner and radially outer peripheral walls 142 and 144, respectively. Three mounting pin openings 146 extend axially through wall 140 at locations equally spaced apart about the circumference of recess 138, and the openings are slightly larger in diameter than the radial width of recess 138 between walls 142 and 144, whereby each of the openings 146 includes diametrically opposed arcuate portions 148 in the radially inner and radially outer peripheries of walls 142 and 144, respectively. Each of the openings 146 is adapted to pivotally receive a mounting pin 130 of a mounting fork 126 of a driving roll unit 106 and, as will become apparent hereinafter, each of the pins 130 has a pivot axis, not designated numerically, which is always parallel to axis A' of the feed unit, is coaxial with axis 110 of the corresponding driving roll unit 106 when the component parts of the latter are in the neutral positions thereof, and is at an angle to axis 110 when the component parts of the corresponding driving roll unit are in an activated position thereof. Recess 138 is adapted to receive a plurality of compression springs 150 each of which extends between the circumferentially opposed flats 136 of adjacent pins 130. The opposite ends of each spring abut against the bottoms of the recessed flats and interengage with the axially outer ends of the recesses in pins 130 to axially retain the pins in the corresponding opening 146. Accordingly, it will be appreciated that support members 100 and 102 are interconnected against axial separation from one another by the interengagement between the compression springs and the recessed flats of pivot pins 130 in recesses 138 of each of the support members. Compression springs 150 serve a further function which is set forth more fully hereinafter.

Figure 12:
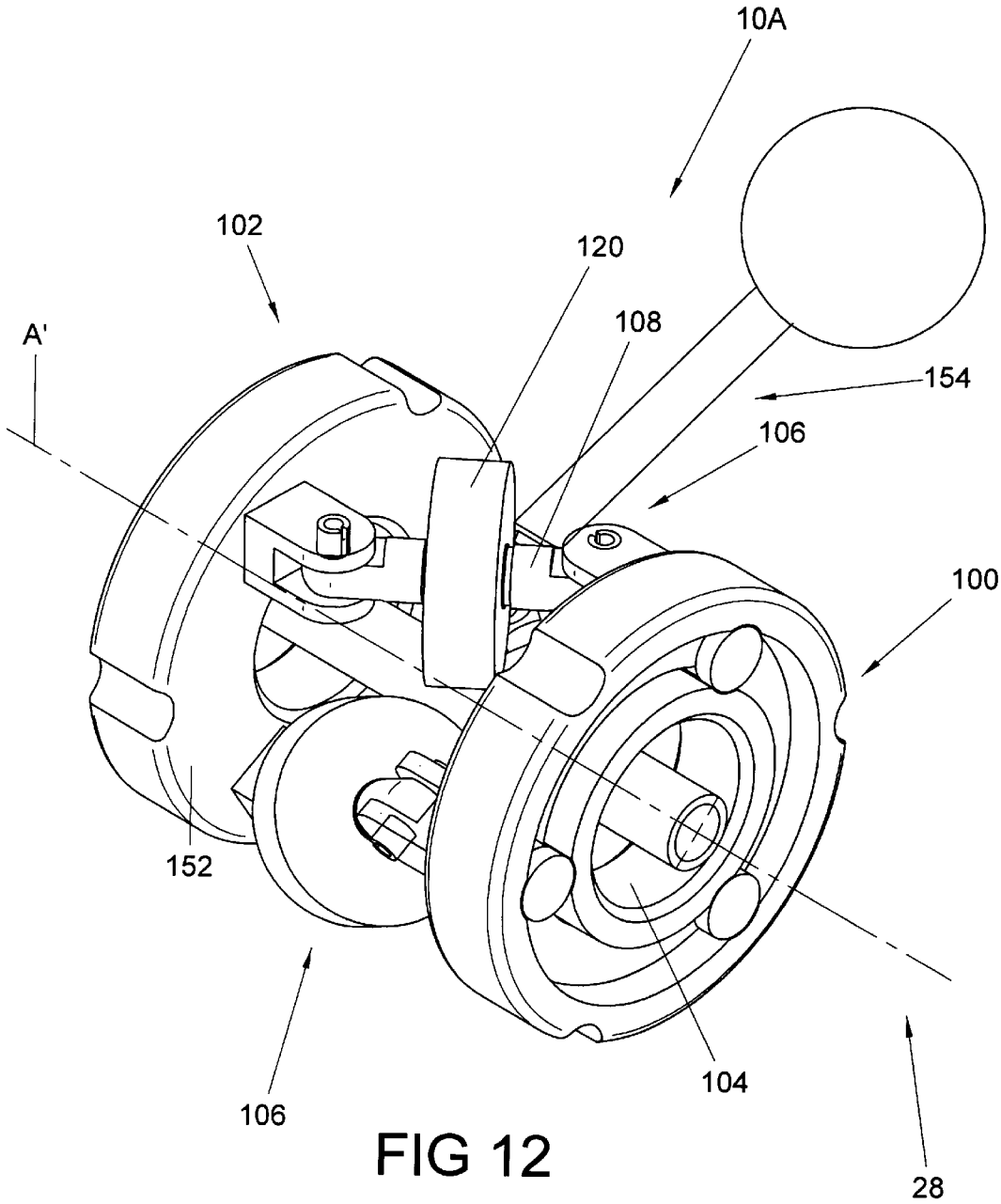

FIGS. 8 and 10 illustrate the component parts of snake feed device 10A in a neutral position thereof in which the axes 110 of driving roll units 106 are parallel to one another and to axis A' of the device. In the neutral position, as will be further appreciated from FIG. 11, each pivot pin axis defined by roll pin 134 between shaft 108 and mounting fork 126 is transverse to shaft axis 110 and axis A' of the device. Accordingly, it will be appreciated that each of the opposite ends of each of the driving roll units 106 is pivotal relative to the corresponding support member about the axis of pin 130 which is parallel to axis A' and about the axis of roll pin 134 which is transverse to the axis of pin 130 and to axis A'. As will be appreciated from FIG. 11, pivotal displacement of each of the pins 30 about its axis pivots flats 136 about the pin axis to displace the corresponding ends of compression springs 150 circumferentially toward the opposite ends thereof, whereby the springs are further compressed to impose a biasing force on flats 136 which biases the mounting pin and thus mounting fork 126 toward the neutral position of the component parts shown in FIG. 8. This pivotal interrelationship between the opposite ends of each of the driving roll units 106 and support members 100 and 102 provides for the support members to be pivotally displaceable relative to one another in opposite directions about axis A' so as to displace the component parts of the driving roll unit between the neutral position shown in FIG. 8 and activating positions in which the shafts 108 and driving roll members 120 of the driving roll units are skewed relative to axis A'. One of the activating positions is shown in FIG. 12 and results from pivotally displacing support member 100 clockwise about axis A' from the position shown in FIG. 8 and relative to support member 102. In the embodiment illustrated, support member 102 is provided with mounting grooves 152 on outer wall 144 thereof for mounting the feed device on drain cleaning apparatus, such as through a mounting bracket as described hereinabove in connection with the embodiment of FIGS. 1–6, and support member 100 is provided with a radially outwardly extending operating handle 154 for displacing the component parts between the neutral and activating positions thereof. As will be appreciated from FIG. 12 and the foregoing description, the release of operating handle 154 will result in the return of the component parts to the neutral position shown in FIG. 8 as a result of the biasing force of compression springs 150 on the flats of pins 130 at both ends of the feed device. As will be further appreciated, displacement of operating handle 154 counterclockwise from the neutral position will displace the component parts of the feed device to a second activating position in which the shafts and driving roll members of the driving roll units are skewed relative to axis A' in the direction opposite that shown in FIG. 12. As will also be appreciated from FIGS. 8 and 12 and the foregoing description, pivotal displacement of support member 100 in either of the opposite directions about axis A' from the neutral position thereof displaces support member 100 axially toward fixed support member 102 and displaces driving roll members 120 from the neutral outer positions thereof to radially inner positions in which the roll members drivingly interengage with a snake extending through the feed device. Accordingly, rotation of the snake in engagement with driving roll members 120 causes displacement of the snake axially relative to the feed device and to the cable drum in which the snake is wound, and the direction of the displacement of the snake inwardly or outwardly of the drum with the latter rotating in a given direction is dependant on the direction of skew of the driving roll units relative to axis A'.

While considerable emphasis has been placed herein on the structures and structural interrelationships between the component parts of preferred embodiments of the invention, it will be appreciated that other embodiments can be devised and that many changes can be made in the preferred embodiments without departing from the principles of the present invention. In this respect, for example, it will be appreciated that the ball and socket arrangement for pivotally interconnecting the driving roll units and housing members in the embodiment of FIGS. 1–6 can be modified to provide an arrangement in which the balls are mounted on the inner walls of the housing and the sockets therefor provided on the opposite ends of the roll shaft. Moreover, it will be appreciated that the sockets for the balls can be provided by the peripheral edges of openings in the support members as opposed to the spherically contoured sockets shown herein. Further, it will be appreciated that the driving roll units of the embodiment shown in FIGS. 8–12 could be mounted on telescopically interengaged housing members such as those shown in the embodiment of FIGS. 1–6 together with a compression spring in the housing for biasing the component parts to the neutral positions thereof or, alternatively, that the support members shown in connection with FIGS. 8–12 could be provided with axially inwardly extending and telescopically interengaging outer walls to enclose the driving roll units. Moreover, in connection with enclosing the roll units, it will be appreciated that a cover member integral with or attached to one of the support members and extending axially across the driving roll units to the other support member could be used instead of telescoping walls on both support members. Still further, it will be appreciated that a biasing spring arrangement could be provided for the embodiment of FIGS. 1–6 which would pivotally bias the housing members relative to one another from an activated to the neutral position as opposed to the compression spring which imposes an axial bias on the housing members. It will be appreciated too that many mounting bracket arrangements can be devised for mounting the feeding device on drain cleaning apparatus. These and other modifications of the preferred embodiments as well as other embodiments of the invention will be obvious from the disclosure herein, whereby the foregoing descriptive matter is to be interpreted merely as illustrative of the invention and not as a limitation.

Having thus described the invention, it is claimed:

1. A feed control device for use with drain cleaning apparatus including an elongate snake having a snake axis and means to rotate the snake about said snake axis, said device having an axis and comprising first and second axially spaced apart support members having openings therethrough for receiving said snake, a plurality of snake driving rolls axially between said support members and spaced apart about said axis of the device, and means interconnecting each of said driving rolls with said first and second support members for said support members to be pivotal relative to one another about the axis of the device to displace said driving rolls between neutral and activating positions in which said driving rolls respectively disengage and drivingly engage said snake.

2. A device according to claim 1, and means for biasing said support members and driving rolls toward said neutral positions thereof.

3. A device according to claim 1, wherein said means interconnecting each of said driving rolls includes a shaft having axially opposite ends, and means pivotally interconnecting each of said opposite ends with a different one of said first and second support members.

4. A device according to claim 1, and a compression spring axially between said first and second support members for biasing said support members and driving rolls toward said neutral position thereof.

5. A device according to claim 1, further including means surrounding said driving rolls between said first and second support members.

6. A device according to claim 1, wherein said means interconnecting each of said driving rolls includes a roll shaft having axially opposite ends and a roll member rotatably mounted on said shaft between said ends, each of said opposite ends being pivotally interconnected with a different one of said first and second support members by a ball and socket connection therebetween.

7. A device according to claim 1, wherein one of said first and second support members includes means for mounting the device on drain cleaning apparatus and the other support member includes an operating handle for rotating the other support member relative to the one support member.

8. A device according to claim 1, wherein said means interconnecting each of said driving rolls includes a shaft having axially opposite ends, means pivotally interconnecting each of said opposite ends with a different one of said first and second support members, and means for biasing said support members and driving rolls toward said neutral position thereof.

9. A device according to claim 8, further including means surrounding said driving rolls between said first and second support members.

10. A device according to claim 9, wherein said means interconnecting each said driving rolls includes the roll shaft having axially opposite ends and a roll member rotatably mounted thereon between said ends, each of said opposite ends being pivotally interconnected with a different one of said first and second support members by a ball and socket connection therebetween.

11. A device according to claim 10, wherein said means for biasing said support members includes a compression spring axially between said support members and radially inwardly of said means surrounding said driving rolls.

12. A feed control device for use with drain cleaning apparatus including an elongate snake having a snake axis, and means to rotate the snake about said snake axis, said device having an axis and comprising first and second axially spaced apart support members having openings therethrough for receiving said snake, a plurality of snake driving roll units axially between said support members and spaced apart about said axis of the device, each said driving roll unit including a roll shaft having a shaft axis and axially opposite ends each interconnected with a different one of said support members for pivotal displacement of the roll shaft relative thereto between neutral and activating positions in which said shaft axis is respectively parallel to and skewed relative to the axis of the device.

13. A device according to claim 12, wherein said first and second support members are relatively rotatable in opposite directions about the axis of the device to shift each said roll shaft between said neutral and activating positions thereof.

14. A device according to claim 12, wherein each said driving roll unit includes a driving roll member mounted on said roll shaft coaxial with said shaft axis and being displaceable with said shaft between said neutral and activating positions thereof.

15. A device according to claim 12, and biasing means for biasing the roll shafts of said driving roll units toward the neutral position thereof.

16. A device according to claim 12, wherein said axially opposite ends of said roll shaft are interconnected with said support members by a ball and socket connection therebetween.

17. A device according to claim 16, wherein each said ball and socket connection includes a ball on each of the opposite ends of said roll shaft and a socket on each of said support members.

18. A device according to claim 17, wherein said first and second support members are relatively rotatable in opposite directions about the axis of the device to shift each said roll shaft between said neutral and activating positions thereof.

19. A device according to claim 18, wherein one of said first and second support members includes means for mounting the device on drain cleaning apparatus and the other support member includes an operating handle for rotating the other support member relative to the one support member.

20. A device according to claim 19, and biasing means for biasing the roll shafts of said driving roll units toward the neutral position thereof.

21. A device according to claim 20, wherein said biasing means includes a compression spring between said support members biasing said support members axially away from one another.

22. A device according to claim 21, wherein each said driving roll unit includes a driving roll member mounted on said roll shaft coaxial with said shaft axis and being displaceable with said shaft between said neutral and activating positions thereof.

23. A device according to claim 16, and a compression spring between said support members biasing said support members axially away from one another.

24. A feed control device for use with drain cleaning apparatus including an elongate snake having a snake axis and means to rotate said snake about said snake axis, said device including a housing having a housing axis and comprising first and second housing members relatively rotatable in opposite directions about said housing axis and providing axially spaced apart end walls transverse to said housing axis and circular wall means between said end walls, openings in said end walls coaxial with said housing axis for receiving said snake, a plurality of snake driving roll units in said housing and spaced apart about said housing axis, each said driving roll unit including a driving roll member mounted on a roll shaft having a shaft axis and axially opposite ends, and means pivotally interconnecting each of said opposite ends with a different one of said end walls, whereby rotation of said housing members relative to one another in opposite directions about said housing axis shifts the axes of said roll shafts between first and second positions in which said roll shafts are respectively parallel to and skewed relative to said housing axis.

25. A device according to claim 24, wherein said means pivotally interconnecting said opposite ends of said roll shafts with said end walls includes a ball and socket joint therebetween.

26. A device according to claim 25, wherein each said ball and socket joint includes a ball on an end of said roll shaft and a socket for said ball on an end wall of said housing.

27. A device according to claim 24, and a compression spring in said housing between said end walls and biasing said housing members axially away from one another.

28. A device according to claim 24, wherein one of said housing members includes mounting means for said device and the other of said housing members includes an operating handle for rotating said other housing member relative to said one housing member.

29. A device according to claim 24, wherein said means pivotally interconnecting said opposite ends of said roll shaft with a different one of said end walls includes a ball on each end of the roll shaft and a socket for the balls on each of the end walls.

30. A device according to claim 29, and a compression spring in said housing between said end walls and biasing said housing members axially away from one another.

31. A device according to claim 30, wherein one of said housing members includes mounting means for said device and the other of said housing members includes an operating handle for rotating said other housing member relative to said one housing member.

32. A device according to claim 29, wherein each said socket has an outer end opening outwardly of the corresponding end wall to receive the corresponding ball and said balls are removably mounted on the ends of the roll shaft.

33. A device according to claim 32, and a compression spring in said housing between said end walls and biasing said housing members axially away from one another.

34. A device according to claim 33, and a compression spring in said housing between said end walls and biasing said housing members axially away from one another.

35. A device according to claim 29, wherein each said socket has an outer end opening outwardly of the corresponding end wall to receive the corresponding ball and said roll shaft is separable between said opposite ends thereof.

36. A feed control device for use with drain cleaning apparatus including an elongate snake and means to rotate the snake, said device having an axis and comprising first and second axially spaced apart support members having openings therethrough for receiving said snake, a plurality of snake driving rolls axially between said support members and spaced apart about said axis, and connecting means interconnecting said driving rolls and said support members for rotation of one of said support members relative to the other in a first direction about said axis to progressively displace said driving rolls from an outer position in which the rolls are transverse to and spaced radially outwardly a given distance from said axis and an inner position in which the rolls are skewed relative to said axis and spaced therefrom a distance less than said given distance.

37. A device according to claim 36, wherein said connecting means provides for rotation of said one support member in a second direction opposite said first direction to progressively displace said driving rolls from said inner position back to said outer position.

38. A device according to claim 37, wherein said inner position is a first inner position and said connecting means provides for rotation of said one support member in said second direction with said driving rolls in said outer position to progressively displace said rolls to a second inner position in which said rolls are skewed relative to said axis and spaced therefrom a distance less than said given distance, said driving rolls in said first and second inner positions being skewed in opposite directions relative to said axis.

39. A device according to claim 38, and spring means for biasing said support members and driving rolls from said first and second inner positions of said rolls to said outer position thereof.

40. A device according to claim 39, wherein each said driving roll includes a roll shaft having a shaft axis and axially opposite ends, said connecting means pivotally interconnecting each of said opposite ends with a different one of said support members.

41. A device according to claim 40, wherein each said connecting means includes a connecting member mounted on a support member for pivotal movement about a first pivot axis parallel to said axis of the device, and an end of a roll shaft interconnected with said connecting member for pivotal movement of the shaft relative thereto about a second pivot axis transverse to said first pivot axis.

42. A device according to claim 41, wherein said spring means bias said connecting members to a position in which said driving rolls are in said outer position.

43. A device according to claim 40, wherein said first and second support members are housing members providing axially outer end walls transverse to said axis of the device, each said connecting means being between an end wall of one of the housing member and an end of a roll shaft.

44. A device according to claim 43, wherein each said connecting means includes a ball on said end of said roll shaft and a socket for said ball on said end wall of said one housing member.

45. A device according to claim 44, wherein said spring means includes a compression spring in said housing members between said end walls thereof.

* * * * *

UNITED STATES PATENT AND TRADEMARK OFFICE

CERTIFICATE OF CORRECTION

PATENT NO. : 6,360,397 B1
DATED : March 26, 2002
INVENTOR(S) : Babb

It is certified that error appears in the above-identified patent and that said Letters Patent is hereby corrected as shown below:

Drawings,
Sheet 7, Figure 7, the numeral “32” should be -- 32a --; the numeral “58” should be -- 58a --; and the reference numeral 46a should be applied to the opening through roll member 32a.
Sheet 9, Figure 9, the reference numeral 126 should be appplied to the mounting fork at the left-hand end of shaft 108.

Column 2,
Line 21, “mini-mum” should read -- minimum --.

Column 4,
Line 22, “interengaged” should be -- interengage --;
Line 31, “form” should be -- forming --; and
Line 35, after “snake” insert -- 28 --;

Column 5,
Line 10, after “feeding” insert -- a --.

Column 6,
Line 4, after “snake” insert -- 28 --;
Line 6, after “10” insert -- along snake axis 28a --;
Line 8, before “free” insert -- the --;
Line 18, after “snake” insert -- 28 --;
Line 20, after “rotates” insert -- the --; and
Line 24, after “removing” insert -- the --.

UNITED STATES PATENT AND TRADEMARK OFFICE

CERTIFICATE OF CORRECTION

PATENT NO. : 6,360,397 B1
DATED : March 26, 2002
INVENTOR(S) : Babb

It is certified that error appears in the above-identified patent and that said Letters Patent is hereby corrected as shown below:

Column 7,
Line 16, insert -- , -- after "76"; and
Line 50, change "about" to -- abut --.

Signed and Sealed this

Twenty-ninth Day of October, 2002

*Attest:*

*Attesting Officer*

JAMES E. ROGAN
*Director of the United States Patent and Trademark Office*